US007385583B2

(12) United States Patent
Kim et al.

(10) Patent No.: US 7,385,583 B2
(45) Date of Patent: Jun. 10, 2008

(54) LIQUID CRYSTAL DISPLAY DEVICE AND DRIVING METHOD THEREOF

(75) Inventors: Myung Hoon Kim, Incheon-si (KR); Hyun Seok Kim, Daegu-si (KR)

(73) Assignee: LG. Philips LCD. Co., Ltd, Seoul (KR)

( * ) Notice: Subject to any disclaimer, the term of this patent is extended or adjusted under 35 U.S.C. 154(b) by 629 days.

(21) Appl. No.: 10/954,944

(22) Filed: Sep. 30, 2004

(65) Prior Publication Data

US 2005/0083294 A1 Apr. 21, 2005

(30) Foreign Application Priority Data

Oct. 21, 2003 (KR) ..... 10-2003-0073478

(51) Int. Cl.
*G09G 3/36* (2006.01)
*G09G 5/10* (2006.01)

(52) U.S. Cl. ..... 345/102; 345/87; 345/690; 345/211

(58) Field of Classification Search ..... 345/102, 345/87, 204, 211, 690
See application file for complete search history.

(56) References Cited

U.S. PATENT DOCUMENTS 5,592,193 A * 1/1997 Chen ..... 345/102
5,731,794 A * 3/1998 Miyazawa ..... 345/88
6,573,882 B1 * 6/2003 Takabayashi ..... 345/102
6,933,918 B1 * 8/2005 Park et al. ..... 345/102
6,943,506 B2 * 9/2005 Moon ..... 315/323
7,199,780 B2 * 4/2007 Sekine ..... 345/102
7,233,304 B1 * 6/2007 Aratani et al. ..... 345/87
7,292,220 B2 * 11/2007 Choi et al. ..... 345/102
2003/0038770 A1 * 2/2003 Lee et al. ..... 345/102

FOREIGN PATENT DOCUMENTS

JP 08-166577 6/1996
WO 03/019271 A2 3/2003

OTHER PUBLICATIONS

Office Action dated Dec. 29, 2006 for corresponding Chinese Patent Application No. 2004100838585.

* cited by examiner

*Primary Examiner*—Duc Q Dinh
(74) *Attorney, Agent, or Firm*—Brinks Hofer Gilson & Lione

(57) ABSTRACT

An apparatus and a method of driving a liquid crystal display device includes generating a first control signal and a second control signal using a vertical synchronization signal and a horizontal synchronization signal, respectively; applying a scan pulse to gate lines depending on the first control signal; applying data to source lines depending on the second control signal; and driving a backlight unit in accordance with a change of state of at least one of the first control signal and the second control signal.

33 Claims, 8 Drawing Sheets

LIQUID CRYSTAL DISPLAY DEVICE AND DRIVING METHOD THEREOF

PRIORITY CLAIM

This application claims the benefit of the Korean Patent Application No. 2003-73478 filed on Oct. 21, 2003, which is hereby incorporated by reference.

BACKGROUND

1. Technical Field

The present application relates to a liquid crystal display device, and more particularly, to a driving method of a liquid crystal display device.

2. Related Art

A liquid crystal display (LCD) device 100, as shown in FIG. 1, includes an interface circuit 101, a timing controller 102, a gate driver 103, a source driver 104, a LCD panel 105, an inverter 106 and a backlight unit 107. If data is supplied from a computer graphics card or the like, the interface circuit 101 generates various signals: for example, a vertical synchronization signal (Vsync), a horizontal synchronization signal (Hsync), a data enable signal and a data clock signal, and transmits these signals to the timing controller 102.

The timing controller 102 generates a control signal for the gate driver 103 and the source driver 104 based on a signal provided from the interface circuit 101, and transmits the control signals to the gate driver 103 and the source driver 104. The control signal transmitted to the gate driver 103 from the timing controller 102 is called a Gate Start Pulse (GSP) and marks a point in time at which a first gate line of a screen is turned-on. The gate line is turned on for a period of one data frame during which the Vsync signal is applied.

The control signal for the gate driver 103 includes a Gate Shift Clock (GSC) and a Gate Output Enable (GOE). The GSC determines a time at which gates of a plurality of thin-film transistors (TFTs) of the LCD panel 105 are turned-on or off, and the GOE controls an output of the gate driver 103.

The control signal, transmitted to the source driver 104 from the timing controller 102, is a Source Start Pulse (SSP) marking a data start time point for the Hsync signal, which is the time at which data is applied to the first source line. The control signal transmitted to the source driver 104 includes a Source Shift Clock (SSC) and a Source Output Enable (SOE). The SSC marks a time for driving the source driver 104, and the SOE determines an output of the source driver 104.

That is, the GSP, the GSC, and the GOE of the control signal generated from the timing controller 102 are provided to the gate driver 103. The SSP, the SSC and the SOE of the control signal generated from the timing controller 102 are provided to the source driver 104.

The gate driver 103 sequentially supplies a scan pulse of a gate high voltage to gate lines according to the GSC provided from the timing controller 102 to transfer data to a liquid crystal cell of the LCD panel 105. The source driver 104 latches data according to the SSP, the SSC and the SOE provided from the timing controller 102 to provide the latched data to the source lines.

The gate lines are sequentially driven to turn on the thin-film transistor of the LCD panel 105 and at the same time, the latched data is transferred to the LCD panel 105. Each pixel electrode has a voltage difference with respect to a common electrode associated with the applied voltage. This voltage difference for each pixel determines the transmission characteristics for each pixel and permits the LCD to display the information provided by the graphics controller, or other data source.

LCD panels do not generally incorporate a source of illumination, information is displayed by reflecting external light traversing the LCD panel 105, or information is displayed by transmitting light generated by a backlight unit 107 having a separate light source, which may be one or more lamps. The former is called a reflective liquid crystal display device, and the latter is called a transmissive liquid crystal display device. If a backlight unit is used it is installed at a rear surface or side surface of the LCD panel 105.

In a high-brightness or large-size liquid crystal display device, the transmissive liquid crystal display device typically employs a direct-type backlight unit where the light source is installed at the rear surface of the LCD panel 105, rather than an edge type backlight unit where the light source is installed at the side surface of the LCD panel 105.

The direct type backlight unit 107 shown in FIG. 2 includes a plurality of lamps 109 arrayed in an array behind the LCD panel 105 to light LCD panel when the lights are turned on. The duration of the illumination is determined by the Vsync signal from the interface circuit 101.

One method of driving the plurality of lamps constituting the direct type backlight unit is a collective-lighting blink backlight method in which the plurality of lamps are collectively turned on during the Vsync period. Another method is a scan backlight method in which the lamps are turned on sequentially beginning from the top most lamp.

FIGS. 3 and 4 are views illustrating the blink backlight method and the scan backlight method, respectively. In the blink backlight method of FIG. 3, the plurality of lamps are turned on and off collectively. In the scan backlight method of FIG. 4, the plurality of lamps are turned on and off sequentially.

In case where the scan backlight method is employed, the plurality of lamps 107 of the backlight unit of FIG. 1 should be turned on and off sequentially during each period for which data is applied. To do this, the backlight unit 107 provides the Vsync signal from the interface circuit 101 to the inverter 106. The inverter 106 determines the on/off duration for the plurality of lamps of the backlight unit 107 depending on the Vsync signal such that a power source (not shown) is applied to the lamp for a predetermined duration. Accordingly, in the backlight unit 107, the lamps are sequentially turned on by the vertical synchronous signal.

The scan pulse of the gate driver 103 and the data of the source driver 104 are provided to the LCD panel 105 depending on the GSP and the SSP.

Referring to FIG. 5, the timing controller 102 generates the GSP, the GSC and the GOE by using the Vsync signal, and generates the SSP, the SSC and the SOE by using the Hsync signal. The GSP, the GSC and the GOE are provided to the gate driver 103, and the SSP, the SSC and the SOE are provided to the source driver 104. The GSP and the SSP are at a predetermined time intervals with respect to the start time of the Vsync signal.

The gate driver 103 applies the scan pulse to the first gate line depending on the GSP and, though not illustrated in FIG. 5, continues to sequentially apply the scan pulse to second, third, . . . , $n^{th}$ gate lines. Whenever the scan pulse is sequentially applied to the gate lines, pixel data are applied to the source lines.

That is, the source driver 104 applies data to the first source line depending on the SSP and at the same time, collectively applies data to the second, third, . . . , $n^{th}$ source lines.

Thus, the LCD panel 105 receives data from each of the source lines being intersected at the first gate line, so as to charge a pixel capacitor to a voltage corresponding to a gray scale value.

After the lapse of a predetermined pixel capacitor charging time, a voltage corresponding to a desired grayscale is present across the pixel capacitance. During the pixel charging time, information is not perfectly displayed on a corresponding pixel, as the voltage is varying. When the pixel capacitor is fully charged, the transmission properties of the liquid crystal of the pixel are controlled on the basis of the voltage difference between the pixel electrode and the common electrode, so as to display the desired gray scale value.

Alternatively, when the scan backlight method is used, the plurality of lamps employing are sequentially turned on and off, beginning from the top to the bottom of the LCD panel, depending on the Vsync signal. Specifically, the first lamp of the scan backlight is synchronized to the vertical synchronous signal to be turned on for a predetermined time at the start time of the Vsync signal.

As such, the related-art liquid crystal display device has a drawback in that a turn-on time point of the lamp leads, by a predetermined time, a time point at which the scan pulse and data are applied by the GSP and the SSP, thereby reducing the power consumption efficiency of backlight unit and the display fidelity.

SUMMARY

A liquid crystal display device and a driving method thereof is described in which a turn-on time point of a first lamp is be consistent with a start time point or an end time point of a Source Start Pulse (SSP) in a scan backlight method which may achieve an optimal driving and reduce power consumption.

A driving method of a liquid crystal display device including, generating a first control signal having a GSP (Gate Start Pulse) and a second control signal having a SSP (Source Start Pulse) by using a vertical synchronous signal and a horizontal synchronous signal; sequentially applying a predetermined scan pulse to gate lines depending on the first control signal; applying data source lines depending on the second control signal; displaying data; and driving a backlight unit by using the GSP and/or the SSP.

In another aspect, a liquid crystal display device includes a controlling unit for generating a first control signal having a GSP (Gate Start Pulse) and a second control signal having a SSP (Source Start Pulse) by using a Vsync signal and a Hsync signal; a gate driver for sequentially applying a predetermined scan pulse to gate lines depending on the first control signal; a source driver for applying data source lines depending on the second control signal; a LCD (Liquid Crystal Display) panel for displaying data; and a driving unit for driving a backlight unit being controlled by the GSP or the SSP.

DETAILED DESCRIPTION

Exemplary embodiments may be better understood with reference to the drawings, but these embodiments are not intended to be of a limiting nature.

Figure 1:
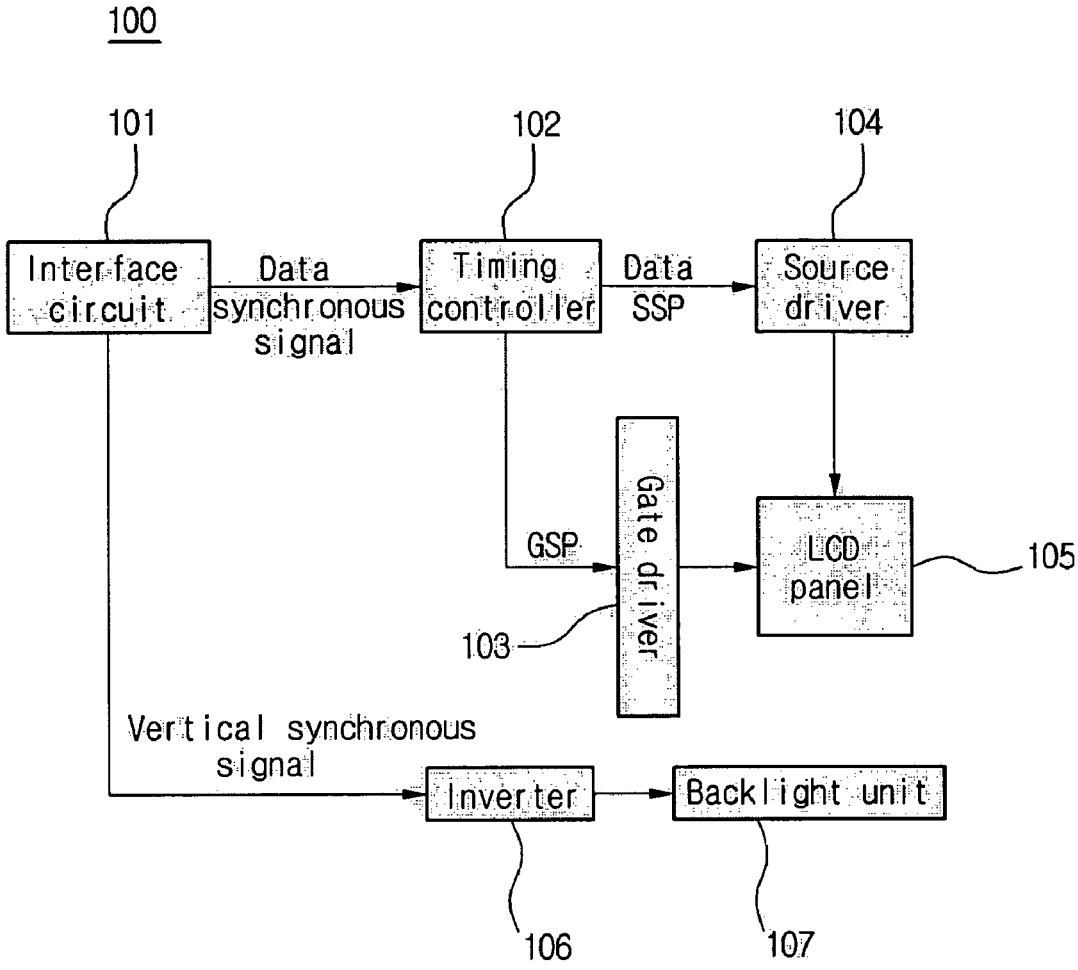
Fig.1 Related Art
FIG. 1 is a block diagram illustrating a construction of a related art liquid crystal display device.
Figure 2:
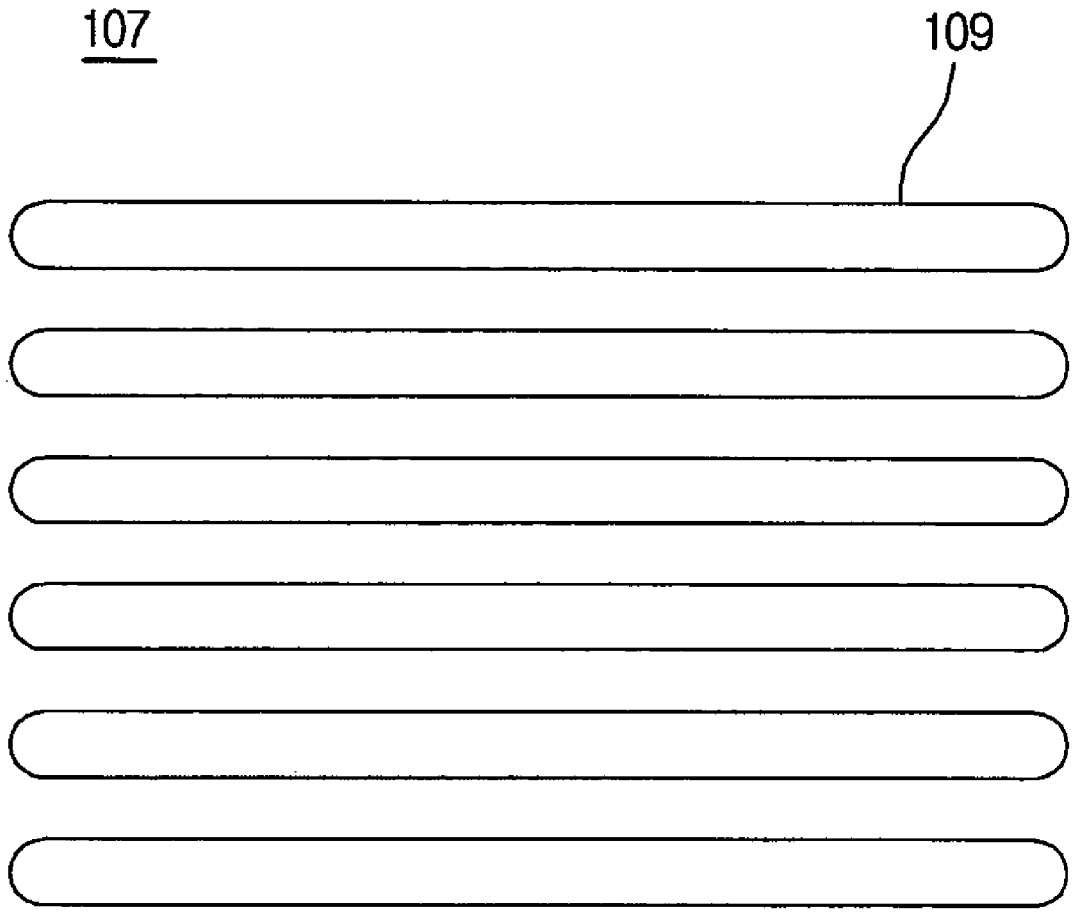
Fig.2 Related Art
FIG. 2 is a view illustrating a lamp array of a related art direct type backlight unit.
Figure 3:
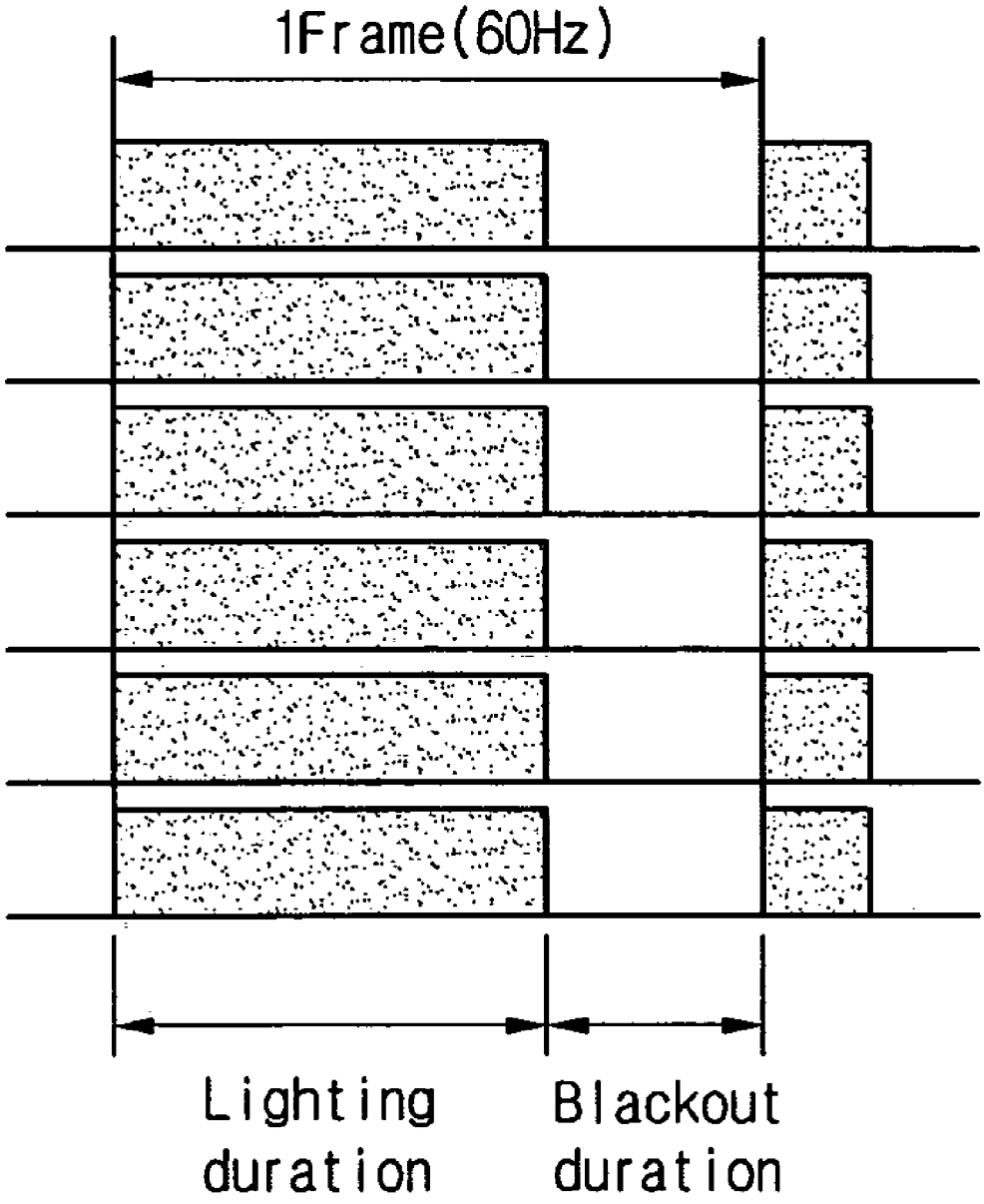
Fig.3 Related Art
FIG. 3 is a waveform view illustrating turning-on/off of a plurality of lamps in a related art blink backlight method.
Figure 4:
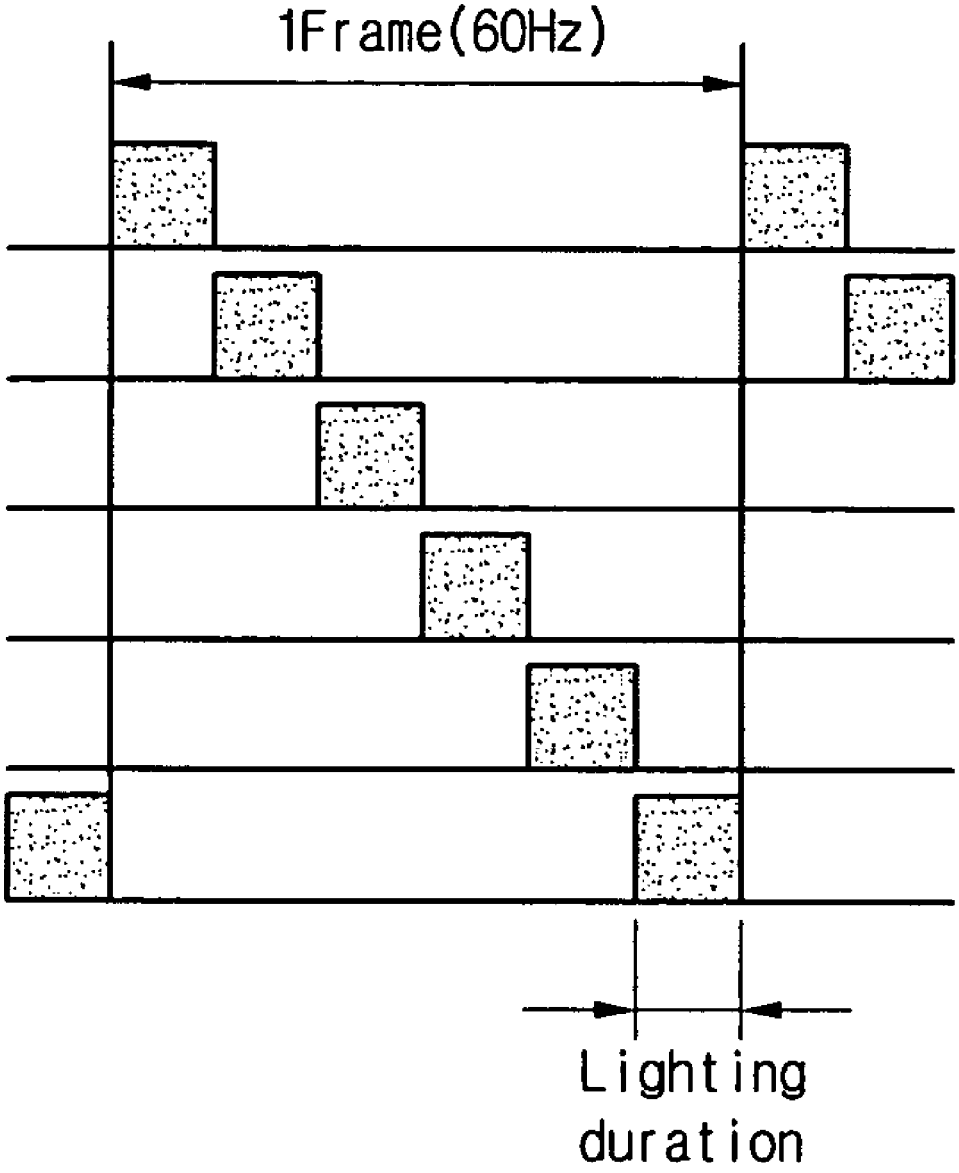
Fig.4 Related Art
FIG. 4 is a waveform view illustrating turning-on/off of a plurality of lamps in a related art scan backlight method.
Figure 5:
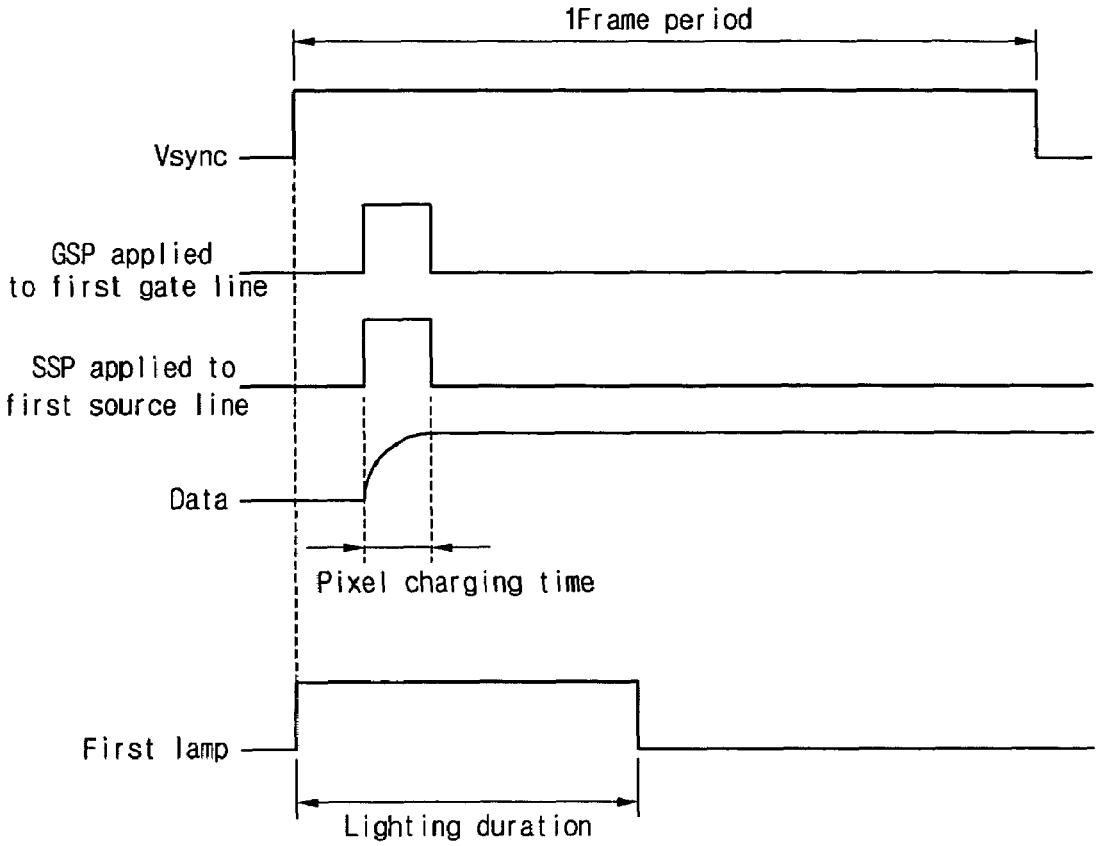
Fig.5 Related Art
FIG. 5 is a waveform view illustrating a related art liquid crystal display device.
Figure 6:
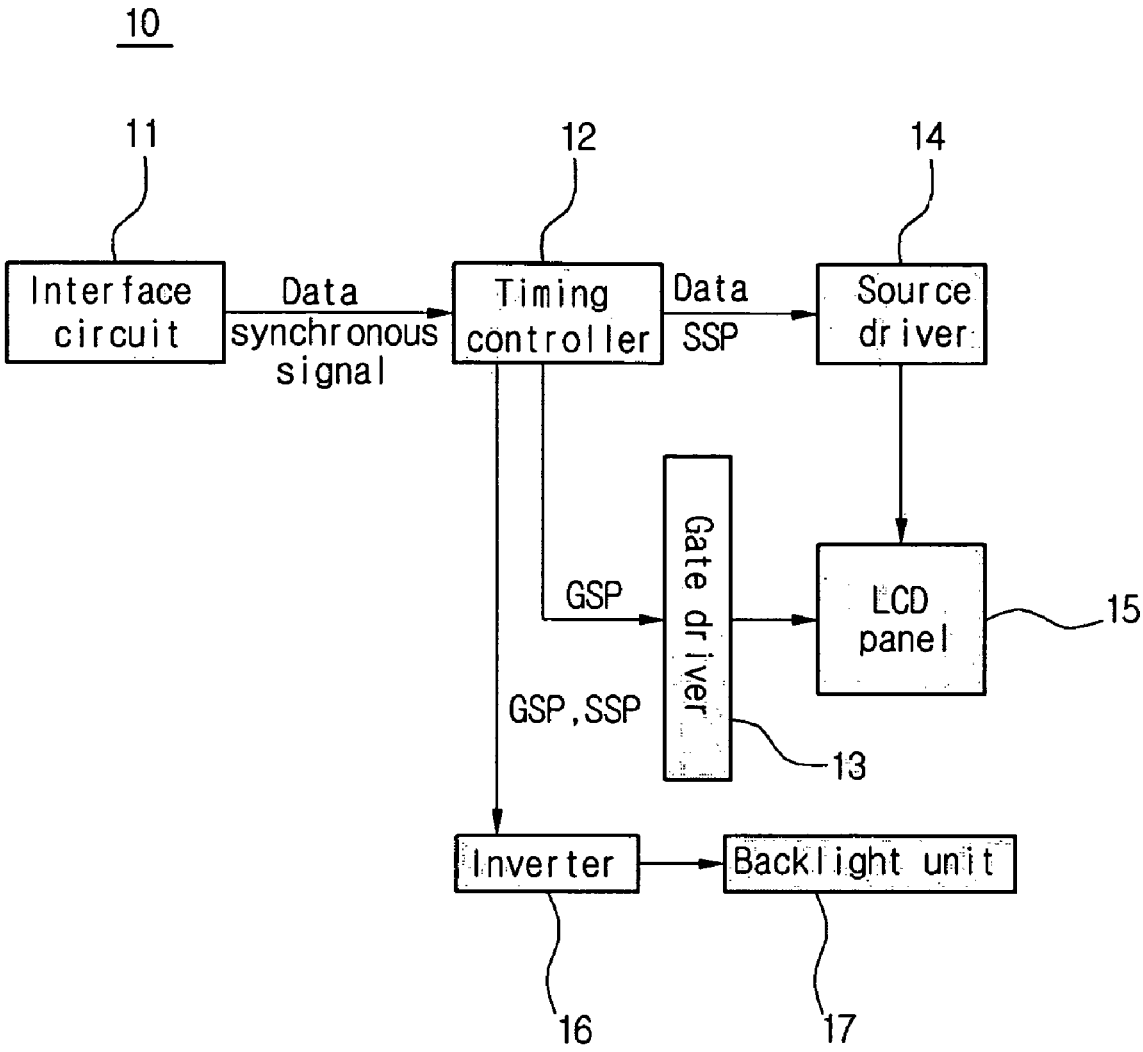
FIG. 6 is a block diagram a liquid crystal display device.

FIG. 6 is a block diagram illustrating a construction of a liquid crystal display device according to a first embodiment. The liquid crystal display (LCD) device 10 includes an interface circuit 11, a timing controller 12, a gate driver 13, a source driver 14, a LCD panel 15, an inverter 16 and a backlight unit 17.

When data is supplied from a computer graphics card graphic card or other data source, the interface circuit 11 generates a vertical synchronization signal (Vsync), a horizontal synchronization signal (Hsync), a data enable signal, and a data clock signal, providing these signals to the timing controller 12.

The timing controller 12 generates a control signal for the gate driver 13 and the source driver 14 based on a signal provided from the interface circuit 11. The control signal provided to the gate driver 13 from the timing controller 12 is a Gate Start Pulse (GSP) marking a time point at which a first gate line of a LCD screen is turned on during one frame period, the frame period corresponding to the period during which the Vsync signal is applied. The GSP may be delayed in time with respect to the Vsync signal.

The control signal provided to the gate driver 13 includes a Gate Shift Clock (GSC) and a Gate Output Enable (GOE). The GSC determines a time at which gates of a plurality of thin-film transistors (TFTs) in the LCD panel 15 are turned-on and off, and the GOE controls an output of the gate driver 13.

The control signal provided to the source driver 14 from the timing controller 12 is a Source Start Pulse (SSP). The SSP marks a data start time point of a Hsync signal which is the time at which data is applied to the first source line.

The control signal provided to the source driver 14 includes a Source Shift Clock (SSC) and a Source Output Enable (SOE). The SSC marks a time for driving the source driver 14, and the SOE determines an output of the source driver 14.

That is, the GSP, the GSC and the GOE of the control signal generated by the timing controller 12 are provided to the gate driver 13. The SSP, the SSC and the SOE of the control signal generated by the timing controller 12 are provided to the source driver 14.

The gate driver 13 sequentially supplies a scan pulse of a gate high voltage to gate lines according to the GSC provided from the timing controller 12 to charge a capacitor of a liquid crystal cell of the LCD panel 15 based on the data on the source lines. The source driver 14 latches data according to the SSC, the SSP and the SOE of the timing controller 12 to provide the latched data to the source lines.

Thus, the gate lines are sequentially driven to turn-on a thin film transistor of the LCD panel 15 and at the same time, the latched data charges the associated pixel capacitor in the LCD panel 15. The pixel electrode and a common electrode have a voltage difference determined by the applied voltage, and this voltage difference affects the transmission characteristics of the LCD cell to display the gray scale information in the data.

The embodiment of FIG. 6 is characterized by plurality of lamps constituting the backlight unit 17 being controlled using the GSP or the SSP provided from the timing controller 12. The GSP and the SSP of the control signal of the timing controller 12 are provided to the inverter 16. The GSP marks the time point at which the first gate line of the screen is turned on for one period for which the Vsync signal is applied. The SSP marks the data start time of one Hsync signal, which is the time at which data is applied to the first source line. The inverter 16 determines a turn-on time point and a lighting duration of a first lamp of the backlight unit 17 on the basis of the GSP or the SSP as a control signal.

The backlight unit 17 receives power for the first lamp, and turns on the first lamp depending on the turn-on time and the lighting duration, which are determined by the inverter 16 of the first lamp of the backlight unit 17.

There may be a plurality of the gate source lines corresponding to each lamp of the backlight unit 17, and each lamp of the backlight unit 17 is maintained in a lit condition while the scan pulse is sequentially applied to the corresponding gate source lines.

A driving method for the liquid crystal display device is described with reference to FIG. 7, which illustrates a waveform view of the liquid crystal display device.

The timing controller 12 generates the GSP, the GSC and the GOE by using the Vsync signal, and generates the SSP, the SSC and the SOE by using the Hsync signal. The GSP, the GSC and the GOE are provided to the gate driver 13, and the SSP, the SSC and the SOE are provided to the source driver 14.

The GSP marks the time at which the first gate line of the screen is turned during the period where Vsync signal is applied. The SSP marks the data start time of a Hsync signal, which is the time at which data is applied to the first source line.

The GSP and the SSP occur at a predetermined time interval with respect to the start time point of the Vsync signal.

Figure 7:
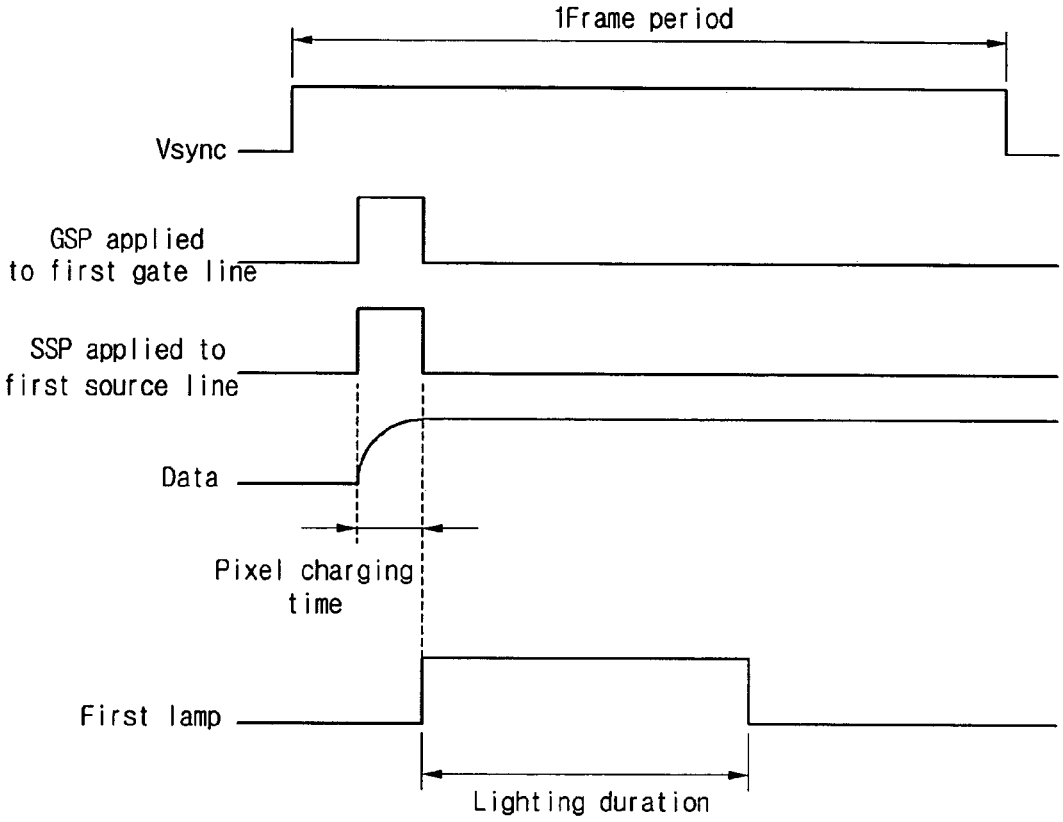
FIG. 7 illustrates a waveform view of a liquid crystal display device according to a first embodiment.

The gate driver 13 applies the scan pulse to the first gate line depending on the GSP and, though not illustrated in FIG. 7, continues to sequentially applies the scan pulse to second, third, . . . , $n^{th}$ gate lines. Whenever the scan pulse is sequentially applied to the gate lines, data is applied to the respective source lines. That is, the source driver 14 applies data to the first source line depending on the SSP and at the same time or sequentially, applies data to the second, third, . . . , $n^{th}$ source lines.

Accordingly, the LCD panel 15 receives data from each of the source lines which intersect the first gate line, to charge to a pixel capacitor to a voltage representing the gray scale values of the data.

After a predetermined pixel charging time, data having a voltage corresponding to a desired grayscale is present on the pixel capacitor.

During the pixel charging time, the voltage on each pixel has not as yet reached the voltage associated with the data representing gray scale values, and may not be accurately displayed. When the capacitor is completely charged, the liquid crystal characteristics are determined by the voltage between the pixel electrode and the common electrode and the gray scale value representing the data will be displayed.

The timing controller 12 provides the GSP and the SSP to the inverter 16 to determine the turn-on time point and the lighting duration of the first lamp of the backlight unit 17 on the basis of the GSP or the SSP.

The lighting duration may be also preset. The inverter 16 determines the turn-on time of the first lamp of the backlight unit 17 on the basis of the GSP or the SSP as a control signal, and can use this determined turn-on time and the lighting duration to drive the first lamp of the backlight unit 17. Backlight unit 17 receives the power to turn on the first lamp depending on the turn-on time and the lighting duration.

The turn-on time of the first lamp of the backlight unit 17 may be synchronized with an end time point of the SSP as the control signal. The backlight unit 17 sequentially turns on the second lamp to the $n^{th}$ lamp following the end time of the lighting duration of the first lamp.

Accordingly, the first lamp of the backlight unit 17 is synchronized and may be turned on at the end time point of the SSP at which data is properly displayed on the pixel. The turn-on time point of the first lamp of the backlight unit may be synchronized to the end time point of the SSP as a control signal, thereby optimizing the driving.

The power consumption of the lamp of the backlight unit may be reduced by preventing the first lamp of the backlight unit from being unnecessarily turned on for the period beginning from the start time of the Vsync signal to the end time of the SSP.

Figure 8:
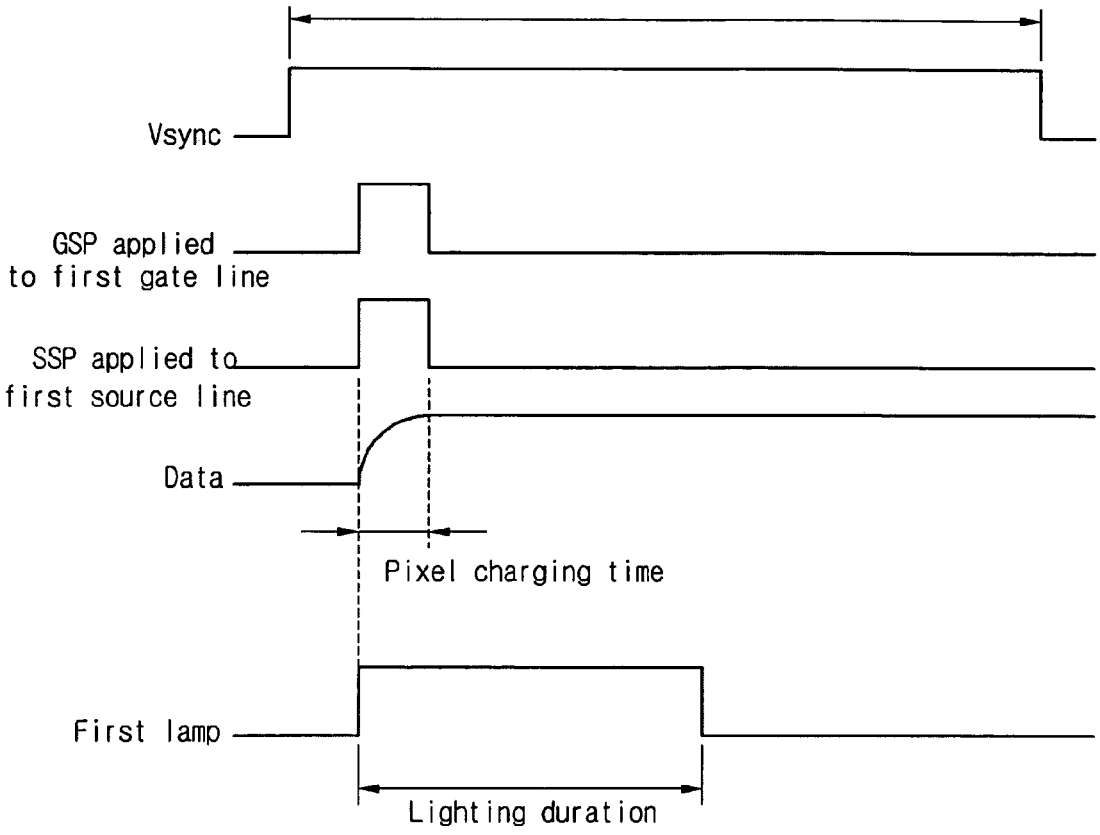
FIG. 8 illustrates a waveform view of a liquid crystal display device according to a second embodiment.

In another embodiment, the first lamp of the backlight unit 17 can be synchronized with the start time of the SSP as a control signal. Referring to FIG. 8, in case where a first lamp of a backlight unit 17 is synchronized with a start time of a SSP, the first lamp of the backlight unit 17 is turned on during a pixel charging time, thereby increasing the power consumption, but this wastes less power than in a case where the turn on of first lamp is synchronized to the start time of the Vsync signal.

As described above, in the liquid crystal display device and the driving method thereof, the turn-on time of the first lamp of the backlight unit is consistent with the end time point or the start time point of the SSP to prevent the unnecessary turn-on duration of the first lamp of the backlight unit.

Although only a few exemplary embodiments of this invention have been described in detail above, those skilled in the art will readily appreciate that many modifications are possible in the exemplary embodiments without materially departing from the novel teachings and advantages of the invention. Accordingly, all such modifications are intended to be included within the scope of this invention as defined in the following claims.

What is claimed is:

1. A driving method of a liquid crystal display device, the method comprising:

generating a first control signal having a change of state at a time delay with respect to a vertical synchronization signal;

applying a scan pulse to gate lines in response to the change of state of the first control signal;

applying data to source lines in response to a change of state of a second control signal;

controlling a backlight unit having a plurality of lamps depending on the change of state of at least one of the first control signal and the second control signal; and wherein a turn-on time point of a first lamp of the lamps is synchronized with the change of state of at least one of the first control signal and the second control signal.

2. The driving method of a liquid crystal display device according to claim 1, wherein the act of controlling a backlight unit comprises controlling a backlight unit sequentially depending on the change of state of at least one of the first control signal and the second control signal.

3. The driving method of a liquid crystal display device according to claim 1, wherein the change of state of the first or the second control signal is a rising edge of a pulse.

4. The driving method of a liquid crystal display device according to claim 1, wherein the change of state of the first or the second control signal is a falling edge of a pulse.

5. The driving method of a liquid crystal display device according to claim 1, wherein the scan pulse is sequentially applied to a group of gate lines.

6. The driving method of a liquid crystal display device according to claim 1, wherein the second control signal comprises a horizontal synchronization signal.

7. The driving method of a liquid crystal display device according to claim 1, wherein the second control signal comprises a source start pulse.

8. The driving method of a liquid crystal display device according to claim 1, wherein the change of state of the second control signal is time delayed with respect to the vertical synchronization signal.

9. The driving method of a liquid crystal display device according to claim 1, wherein the time delay is greater than or about equal to about a pixel capacitor charging time.

10. The driving method of a liquid crystal display device according to claim 1, wherein the first lamp is turned on depending on the change of state of at least one of the first control signal and the second control signal.

11. The driving method of a liquid crystal display device according to claim 1, wherein the first lamp is turned on for a predetermined period of time.

12. The method according to claim 1, wherein controlling the backlight unit comprises:

determining a turn-on time point of the first lamp on the basis of the change of state of the first or the second control signal;

lighting the first lamp during a lighting duration; and lighting a second lamp of the plurality of lamps after the lighting duration of the first lamp.

13. The driving method of a liquid crystal display device according to claim 12, wherein the lighting duration is a predetermined period of time.

14. The driving method of a liquid crystal display device according to claim 12, wherein the lighting duration is a predetermined number of changes of state of the second control signal.

15. The driving method of a liquid crystal display device according to claim 12, wherein the turn-on time is delayed with respect to the vertical synchronization signal by at least approximately a pixel capacitor charging time.

16. The driving method of a liquid crystal display device according to claim 12, where the change of state of the second control signal is delayed with respect to the vertical synchronization signal.

17. A liquid crystal display device comprising:

a LCD panel, including gate and data lines;

a backlight unit disposed behind the LCD panel;

an electronics unit, adapted to receive signals including data and a vertical synchronization signal, the electronics unit outputting a first control signal having a time delay with respect to the vertical synchronization signal, and a second control signal associated with a horizontal synchronization signal;

a gate driver for applying a scan pulse to gate lines depending on a change of state of the first control signal;

a source driver for applying data to source lines depending on a change of state of the second control signal;

a driving unit for driving the backlight unit having a plurality of lamps in accordance with the change of state of the first control signal or the second control signal; and wherein a turn-on time point of a first lamp of the lamps is synchronized with the change of state of at least one of the first control signal and the second control signal.

18. The liquid crystal display device according to claim 17, wherein the scan pulse is sequentially applied to a group of gate lines.

19. The liquid crystal display device according to claim 17, wherein the backlight unit comprises a plurality of lamps.

20. The liquid crystal display device according to claim 19, wherein each lamp is turned on for a predetermined time.

21. The liquid crystal display device according to claim 20, wherein the plurality of lamps are turned on for a varying predetermined times.

22. The liquid crystal display device according to claim 19, wherein the first lamp of the plurality of lamps is turned on based on the change of state of the first control signal or the second control signal.

23. The liquid crystal display device according to claim 22, wherein a second lamp of the plurality of lamps is turned on after the change of state of the first control signal and a predetermined number of changes of state of the second control signal.

24. The liquid crystal display device according to claim 17, wherein the LCD panel comprises pixels, each pixel having a capacitor, the capacitor having a charging time constant, and wherein the change of state of the first control signal with respect to the vertical synchronization signal by a time at least equal to approximately a pixel capacitor charging time constant.

25. The liquid crystal display device according to claim 24, wherein the LCD panel comprises pixels, each pixel having a capacitor, the capacitor having a charging time constant, and wherein the change of state of the second control signal with respect to the horizontal synchronization signal by a time at least equal to approximately a pixel capacitor charging time constant.

26. The liquid crystal display device according to claim 17, wherein the LCD panel comprises pixels, each pixel having a capacitor, the capacitor having a charging time constant, and wherein the change of state of the second control signal with respect to the horizontal synchronization signal by a time at least equal to approximately a pixel capacitor charging time constant.

27. The liquid crystal display device according to claim 22, wherein the first of the plurality of lamps is disposed behind a first predetermined number of gate lines, and the second of the plurality of lamps is disposed behind a second predetermined number of gate lines, and the first lamp is turned on depending on a change of state o the first control signal or the second control signal applied to a first of the second predetermined number of gate lines.

28. The liquid crystal display device according to claim 22, wherein a second lamp is turned on after a predetermined time.

29. The liquid crystal display device according to claim 17, wherein the change of state of the first or the second control signal is a rising edge of a pulse.

30. The liquid crystal display device according to claim 17, wherein the change of state of the first or the second control signal is a falling edge of a pulse.

31. The liquid crystal display device according to claim 17, wherein the control signal is a first gate start pulse following the start of the vertical synchronization signal.

32. The liquid crystal display device according to claim 17, wherein the first control signal comprises a gate start pulse following the start of the vertical synchronization signal.

33. The liquid crystal display device according to claim 17, wherein the second control signal comprises a source start pulse following the start of the horizontal synchronization signal.

* * * * *